US005337858A

United States Patent [19]

Neubauer et al.

[11] Patent Number: 5,337,858

[45] Date of Patent: Aug. 16, 1994

[54] SAFETY SYSTEM FOR MULTI-STAGE LIFTS

[75] Inventors: Willi B. Neubauer, Seattle; Paul K. Smith; Philip J. Harvey, both of Kirkland, Wash.

[73] Assignee: Genie Industries, Redmond, Wash.

[21] Appl. No.: 5,832

[22] Filed: Jan. 19, 1993

[51] Int. Cl.[5] ..... B66B 9/20

[52] U.S. Cl. ..... 182/148; 182/145; 182/18; 182/19

[58] Field of Search ..... 182/148, 63, 19, 145, 182/18; 280/43.12–43.14, 43.22–43.24

[56] References Cited

U.S. PATENT DOCUMENTS

| | | | |
|---|---|---|---|
| 3,240,008 | 3/1966 | McMullen | 280/43.23 X |
| 3,372,769 | 3/1968 | Jung et al. | 280/43.12 X |
| 3,528,675 | 9/1970 | Brown | 280/43.23 |
| 3,934,681 | 1/1976 | Herrell | 182/148 X |
| 4,458,785 | 7/1984 | Bushnell, Jr. | 182/63 X |
| 4,618,307 | 10/1986 | Kress et al. | 280/43.23 X |

*Primary Examiner*—Alvin C. Chin-Shue
*Attorney, Agent, or Firm*—Seed and Berry

[57] ABSTRACT

A lift has a base frame supported on a pair of screw jacks and a pair of support legs when a multi-stage mast on the lift is to be raised. The support legs are slide mounted in guides and each is downwardly biased away from a control switch on the base frame so that the switch is open unless the leg is loaded by the weight of the lift. A transport carriage is mounted to roll on sloped tracks on the base frame and is connected to the base frame by a hydraulic cylinder unit which functions when activated to pull the carriage downwardly into ground engagement to take the load of the lift from the jacks and support legs. A control circuit prevents the mast from being raised while the lift is supported on the carriage.

20 Claims, 6 Drawing Sheets

Fig. 1
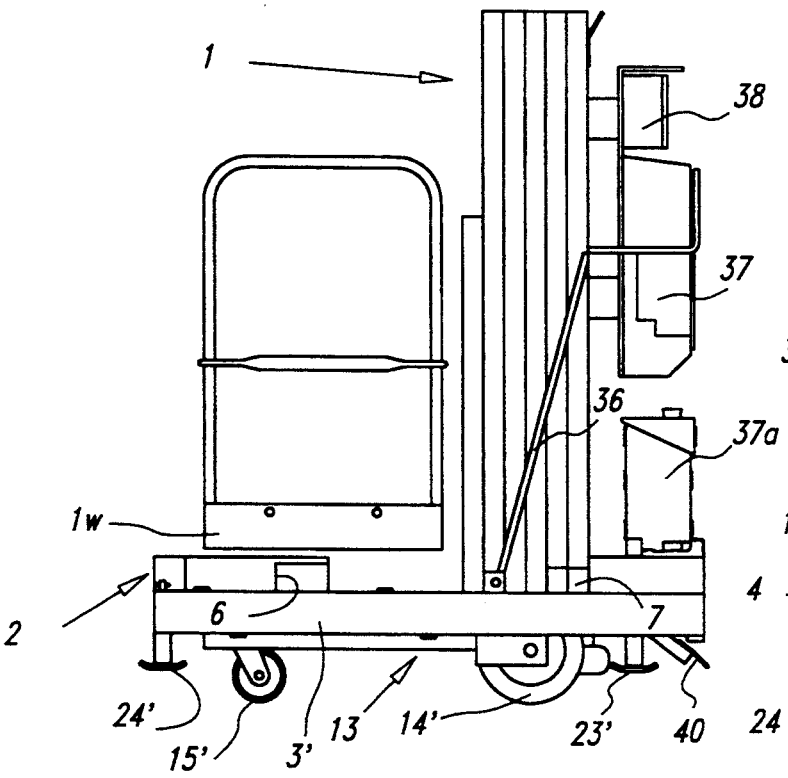
Fig. 2
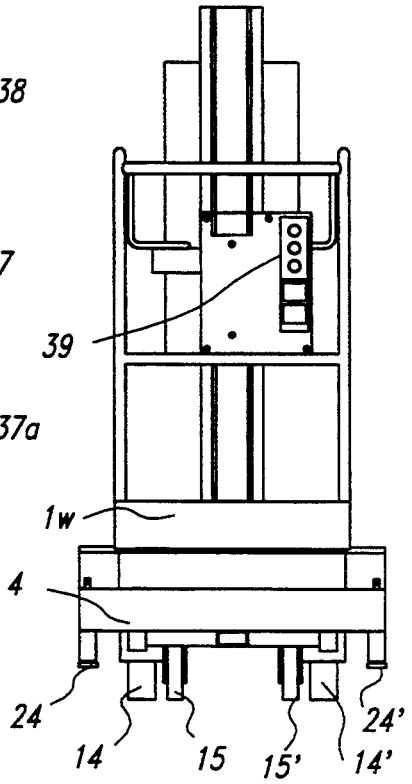
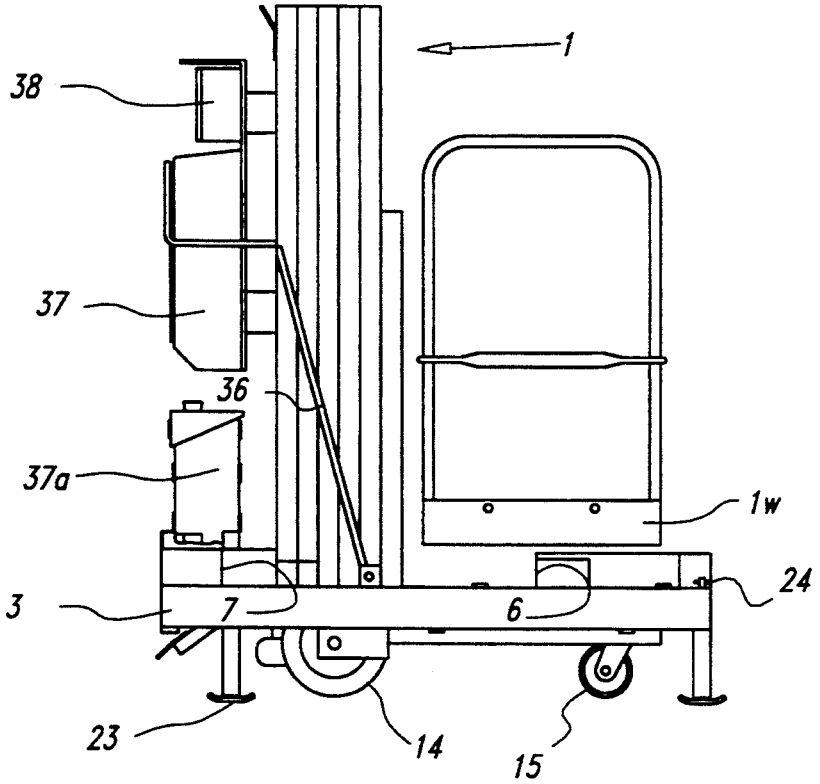
Fig. 3

Fig. 5
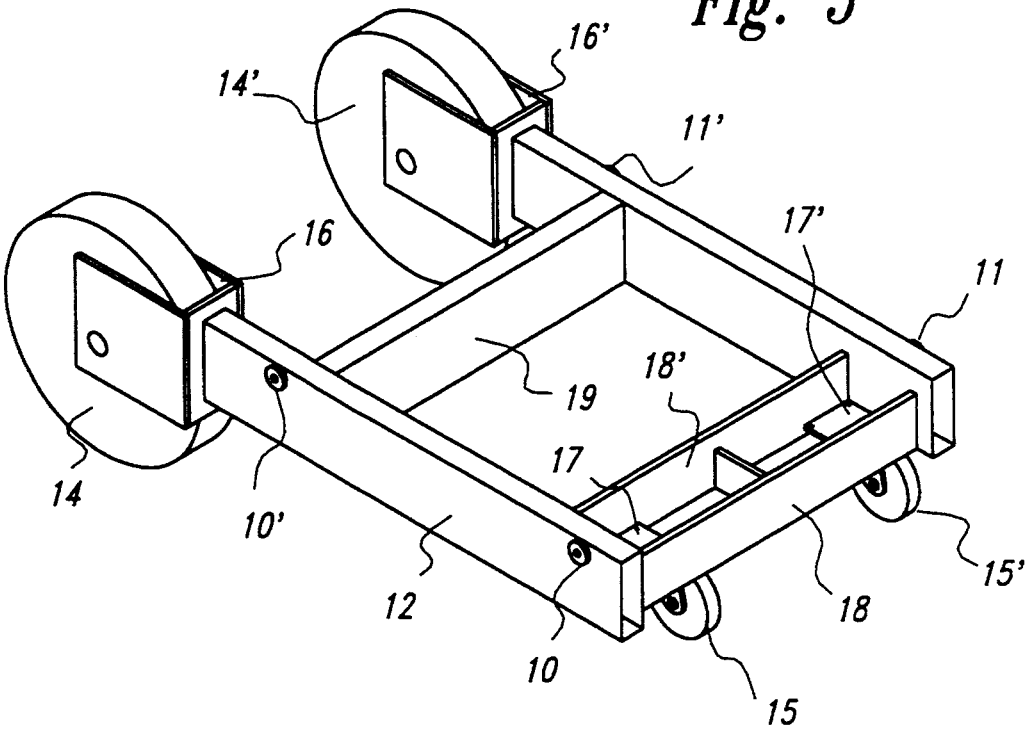
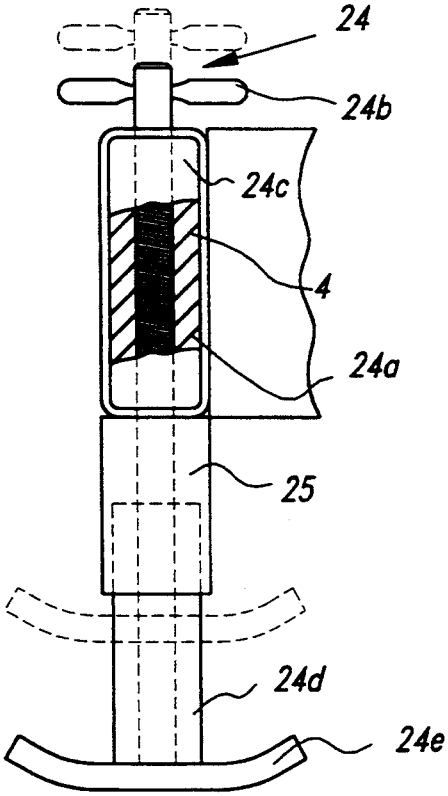
Fig. 6
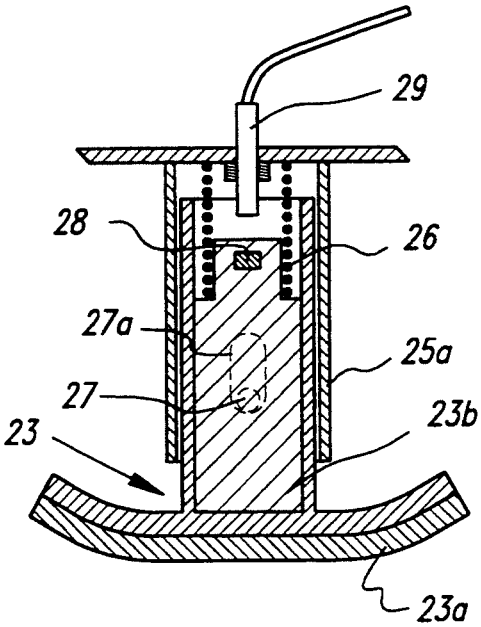
Fig. 7

SAFETY SYSTEM FOR MULTI-STAGE LIFTS

TECHNICAL FIELD

The present invention relates to a safety system for multistage portable lifts of the type which do not have outriggers to maintain stability, but instead are weighted such as to offset the tilting moment exerted by the load being lifted. Such lifts will be referred to as "weighted lifts".

BACKGROUND OF THE INVENTION

For ease of moving from one work site to another, it is often preferred to use a relatively light lift and rely primarily on retractable or removable outriggers for stability rather than relying on the weight and weight distribution of the lift structures for stability. Typical portable lifts with outriggers are shown in U.S. Pat. Nos. 4,015,686; 4,458,785 and 5,121,816, for example. As shown in the latest of these patents, it is preferred to provide a safety system which does not permit the work platform to be raised unless the outriggers are in proper supporting position.

There is also a need in portable weighted lifts of the type which can be moved on the work site on wheels and/or casters to provide a safety system to disable the system for raising the work platform whenever the support base for the lift is not level or does not have stable ground support adjacent its four corners.

SUMMARY OF THE INVENTION

In accordance with the present invention a weighted lift is supported entirely on corner jacks and legs on a base frame when the work platform is raised, and is supported on wheels and/or casters provided by a carriage when being moved. The carriage is mounted on the base frame for up and down movement relative to the base frame to take the full weight of the lift structure when the carriage is lowered. Lowering of the carriage into a load carrying position is prevented unless the work platform is in fully lowered position, and raising of the work platform is prevented whenever the carriage is in lowered lift supporting position or whenever the base frame is not level and/or does not have firm ground support on all four corners.

Lowering of the carriage involves retraction of the piston rod of a hydraulic cylinder unit which has the small piston area side of its cylinder pressurized by a foot pump whose operation is prevented unless the load platform is in fully lowered position whereat a dump valve in the hydraulic circuit for the foot pump is opened to connect the large area side of the cylinder to a sump tank. Otherwise the large piston area side of the carriage lowering cylinder can not be emptied, thereby preventing operation of the foot pump. Furthermore, whenever the lift cylinder is pressurized for lifting, the large piston area side of the cylinder is also pressurized at the lift cylinder pressure. The resulting force on the piston can not be overcome by operation of the foot pump.

Each leg on the base frame is spring-loaded to extend to an extended position when not loaded whereat a safety switch in the leg is opened. When this occurs the power circuit to the motor for driving the pump for pressurizing the lift cylinder is disabled. The center of gravity of the lift is located such that one of the base frame legs will always be in extended position whenever one of the casters and/or one of the legs is not bearing a proper share of the weight of the lift.

As a further safety feature a level indicating switch is mounted on the lift so as to be open whenever the base frame of the lift is not substantially level. This switch is also located in the power supply circuit for the lift pump motor.

BRIEF DESCRIPTION OF THE DRAWINGS

FIG. 1 is a left side elevational view of a lift embodying the present invention shown in transporting position supported by its carriage;

FIG. 2 is a front elevational view of the lift also shown in transporting position;

FIG. 3 is a right side elevational view of the lift shown in normal operating position;

FIG. 5 is an isometric view of the carriage frame assembly;

FIG. 6 is an enlarged elevational view showing one of the screw jack units in extended position;

FIG. 7 is a detail vertical sectional view of one of the support leg units;

DETAILED DESCRIPTION OF THE INVENTION

Figure 4:
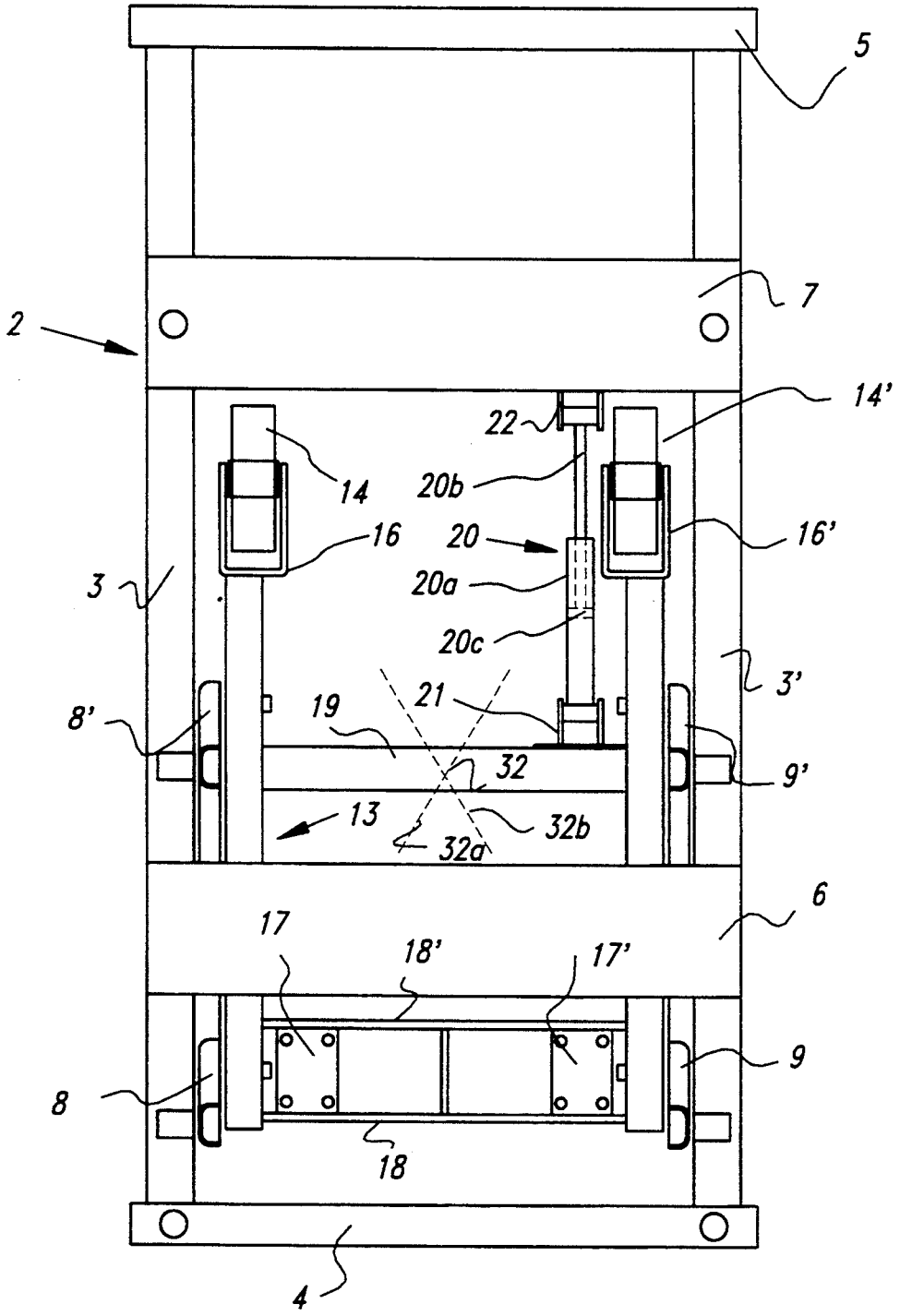
FIG. 4 is a top plan view of the base frame and carriage frames in assembled position.

Referring to the drawings an extendable mast 1 carries a work platform 1-*w* and is mounted on a generally rectangular base frame 2 having right and left longitudinal frame members 3, 3' connected by front and rear members 4, 5 and top cross-members 6, 7, The latter are tubular to receive the forks of a forklift truck for lifting the lift onto a truck or trailer bed, for example. Mounted on the inner faces of the longitudinal frame member 3, 3' are right and left opposing pairs 8—8' and 9—9' of channel tracks. Each track slopes downwardly toward the rear of the base frame 2 at about forty-five degrees. Riding in the sloped tracks are right and left pairs 10, 10' and 11, 11' of rollers mounted on longitudinal side rails 12, 12' of a transport carriage 13 which has a pair of rear wheels 14, 14' and a pair of front swivel casters 15, 15'. The rear wheels are journal-mounted on fork units 16, 16' secured at the ends of the side rails 12, 12' and the front casters are mounted beneath pads 17, 17' fixed between a pair of front cross-members 18, 18'. Further cross support for the carriage frame is provided by a cross-beam 19.

A hydraulic carriage lowering cylinder unit 20 is mounted with its cylinder 20*a* pivotally mounted on a fork unit 21 secured at the back of the carriage beam 19, and the rod 20*b* of its piston 20*c* pivotally mounted at its outer end between a pair of ears 22 provided at the front of the rearmost top cross-member 7 on the base frame 2. It will be appreciated that extension of the piston rod 20*b* responsive to supplying pressurized fluid to the front large area side of the piston 20*c* will force the carriage 13 downwardly and rearwardly by way of travel of the carriage rollers 10, 10' and 11, 11' in the sloped tracks 8, 8' and 9, 9' on the base frame 2 until the carriage 13 takes over the weight of the lift.

The base frame 2 is normally supported on the ground by a pair of rear support legs 23, 23' and a pair of front screw jacks 24, 24'. Referring to FIG. 6, the screw jacks each have a threaded rod **24*a* extending downwardly from a handle 24*b* through a tapped block 24*c* in the front base frame member 4 and then into a post 24*d* having a foot pad 24*e* to which the lower end of the rod is connected. The post 24*d* is slide mounted in a respective tubular guide 25 depending from the frame member 4**.

Referring to FIG. 7, the support legs 23, 23' are vertically slide mounted in rigid guides **25*a* which are fixed to the base frame 2 and have anti-skid foot pads 23*a* mounted on their lower end. Compression springs 26 engage an insert 23*b* plugged into each support leg to bias the support leg downwardly relative to the base frame. The range of sliding movement of each support leg is controlled by movement of a cross-pin 27 extending through the support leg and insert 23*b* and having its ends riding in a pair of slots 27*a* in the support leg. A permanent magnet 28 is mounted on the upper end of each insert 23*b* to close a respective normally-open magnetic reed-type switch 29 or 29' on the base frame 2 when the corresponding support leg 23, 23' is retracted responsive to taking part of the weight of the lift. As will later be discussed, the switches 29—29' are arranged in the power circuit for the motor 30 operating the pump 31 for supplying pressurized hydraulic fluid to the lift cylinder 20 such that when either of the switches is open, the pump 31 is inoperative. Thus, unless both front support legs 23, 23' are loaded by the weight of the lift, the mast 1** cannot be raised.

The base frame is provided with counterweights (not shown) adjacent the front top cross-member 6 so that the center of gravity of the lift is located adjacent the center intersection 32 of the diagonals **32*a*, 32*b* connecting the front jacks 24, 24' with the respective diagonally opposite support legs 23, 23'. The center of gravity is close enough to this center intersection 32 (FIG. 4) that if one of the front jacks is not in ground engagement, the respective diagonally opposite support leg will extend by the biasing force of its spring 26 and responsively rock the base frame 2 toward the jack 24 or 24' which was not in ground contact because, for example, the jack is positioned over a drain depression. As a result, the switch 29 or 29' in this extended support leg opens and deactivates the pump motor 30 so that the work platform 1-*w* can not be raised. The same result will of course occur if one of the support legs 23, 23'** extends because it is positioned over a depression. Preferably the lift has a display system having a display panel indicating which support leg or diagonally opposite screw jack is not loaded. Then the operator can readily correct the situation by extending or retracting the concerned screw jack.

The mast 1 may be of the type shown in the aforementioned patents and has a rear fixed stage **1-*a* and successive forward stages each slidably mounted at the front of the next rearward stage. The work platform 1-*w* is located at the front of the foremost stage 1-*d* and rests on the base 2 when in lowered position. Raising of the lift is performed by extension of a lift cylinder unit 33 mounted on a forwardly extending foot member 34 having a pair of mounted legs 34*a* extending upwardly into the bottom stage 1-*a* of the mast and a pair of rearwardly projecting heel portions 34*b*. The bottom stage 1-*a* is secured at the front of the cross-member 6 to a cross-plate 35 and is braced by a pair of tubular braces 36. The lift cylinder unit extends within the second stage 1-*b* from the foot member 34 to an attachment at the top of the second stage. A prior art system of cables or chains disclosed in the previously mentioned patents causes the third and fourth stages 1-*c*, 1-*d* to raise as the second stage 1-*b*** is raised by the lift cylinder.

A battery power pack **37*a* is mounted on the base frame 2 behind the mast. Spaced above the power pack is a hydraulic power unit 37 and an electrical control box 38 which are mounted on the back side of the stationary bottom stage 1-*a* of the mast. A handle unit is provided for manual gripping behind the power unit 37. The work platform 1-*w* has a control panel 39** and preferably has a guard fence.

Figure 8:
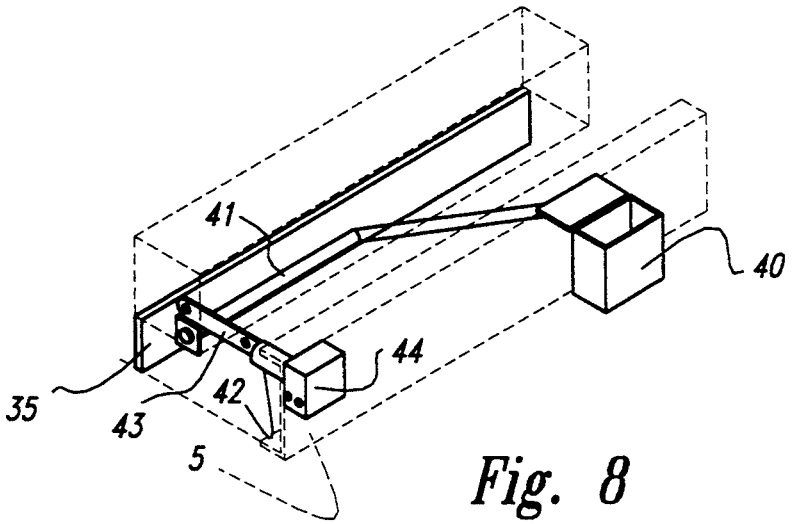
FIG. 8 is a detail view showing the foot pump arrangement.
Figure 11:
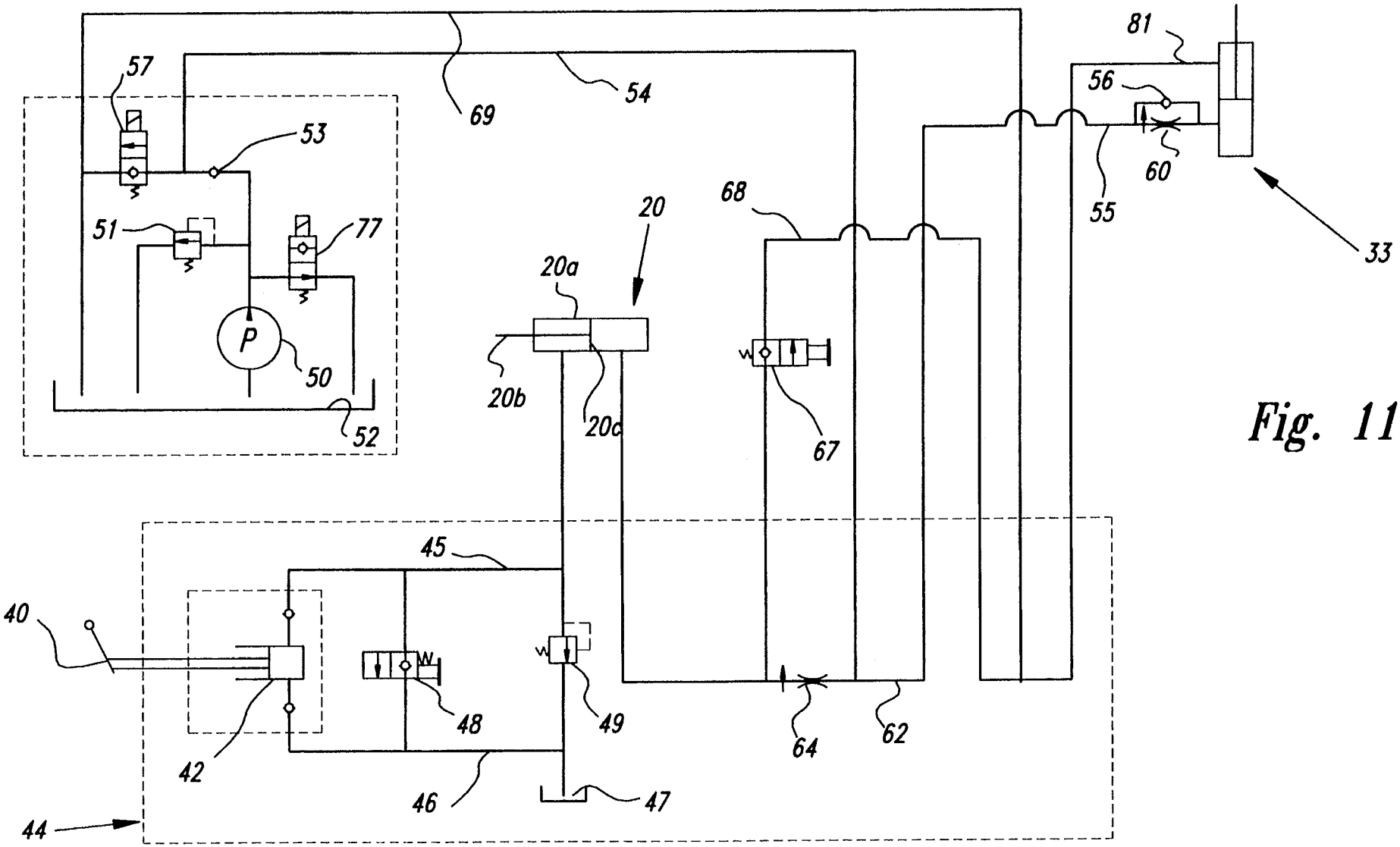
FIG. 11 is a schematic of the hydraulic system.

Directing attention to FIG. 8, the piston rod **20*a* of the carriage lowering cylinder unit 20 is retracted for lowering the carriage 13 to bring its wheels 14, 14' and casters 15, 15' into ground engagement by operation of a foot pedal 40 extending rearwardly through a cutout in the rear base frame member 5 from a shaft 41. This shaft is mounted at the rear of the cross-plate 35 and connects to a foot pump 42 by a linkage 43. The pump 42 is mounted on a pump manifold 44 inturn mounted at the front of the frame member 5. The manifold 44 has a hydraulic lines 45, 46 to the small area side of the carriage lowering cylinder unit 20 and to a foot pump reservoir 47, respectively. The hydraulic circuit for the foot pump 42 also includes a manual release valve 48 and a pressure relief valve 49 each of which, when opened, dumps the output from the foot pump 42 to the reservoir 47 as indicated in FIG. 11**.

The large area side of the piston **20*c* in the carriage lowering cylinder unit 20 is connected to the hydraulic circuit for the lift cylinder unit 33 so that, as will later be explained, the piston rod 20*b* of the carriage lowering cylinder unit can not be retracted when the lift cylinder is pressurized. If while the lift is being rolled on a sloped surface to a work site on its wheels 14, 14' and casters 15, 15' and appears to be in danger of rolling out of control, the weight of the lift can be quickly manually shifted to the jacks 24, 24' and the support legs 23, 23' to stop the lift by opening the manual release valve 48, thereby deactivating the cylinder unit 20 by causing the hydraulic fluid on the piston rod end of the cylinder 20 to discharge to the reservoir 47**.

The hydraulic power unit 36 has a pump 50 for supplying the lift cylinder 33 to raise the platform **1-*w*. The pump 50 has a pressure relief valve 51 set to bypass to a sump 52 when the pressure builds to the amount sufficient to have fully lifted the lift platform when carrying a maximum specified load. Supply from the pump 50 flows through a check valve 53 to the underside of the piston in the lift cylinder via lines 54, 55 and a second check valve 56. To lower the lift there is provided a normally closed dump valve 57 which is both solenoid operated and manually operated. The solenoid for the dump valve 57 is connected to a control switch on the control panel 39 at the work platform. A lever for manual operation of the dump valve 57 is located at a convenient location on the handle 38 or hydraulic power unit 36 and is intended for emergency use should the person on the work platform be unable to lower it. The rate of retracting the lift cylinder 33 is controlled by an orifice 60 in parallel relation to the adjacent check valve 56**.

Branching from the supply circuit from the pump 50 to the lift cylinder 33 is a branch line 62 connecting to the carriage cylinder unit 20 at the larger side of its piston 20c. This branch 62 has a pressure compensated flow control 64. This arrangement loads the larger area of the piston 20c of the carriage lowering cylinder unit 20 such as to overcome any load that could be exerted on the smaller area of the piston 20c by operation of the foot pump 42. This arrangement makes it impossible to lower the carriage 13 by operation of the foot pump 42 such as to cause the carriage wheels 14, 14' and casters 15, 15' to carry the load of the lift when the work platform is in an elevated condition.

Figure 9:
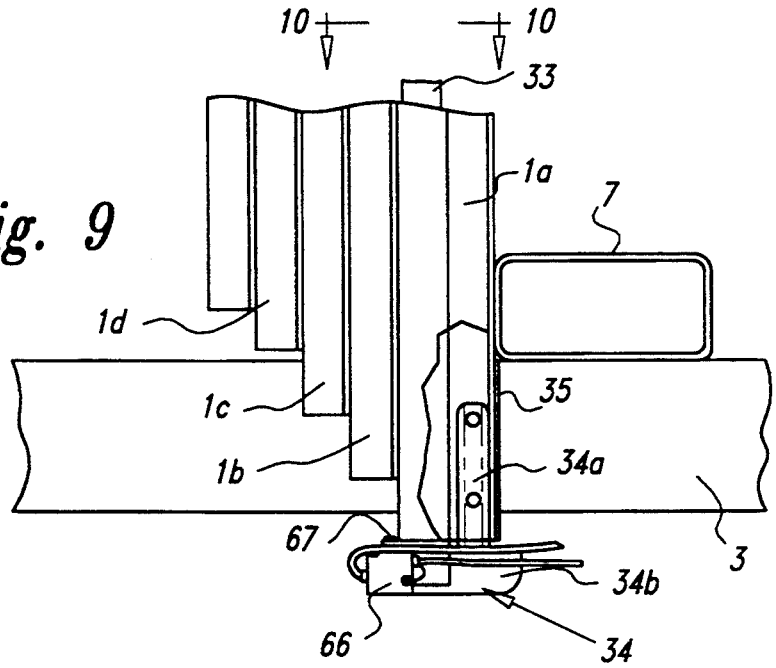
FIG. 9 is a detail elevational view of the left side of the lift with the mast in partially raised position.
Figure 10:
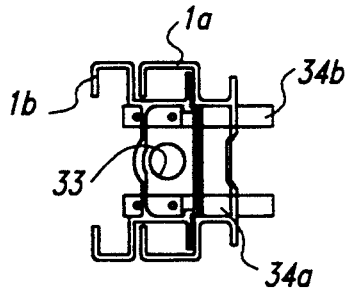
FIG. 10 is a top view taken as indicated by line 10—10 in FIG. 9.

As an additional safety feature the base of the mast 1 has a normally-closed hydraulic safety valve 66 (FIGS. 9, 11) arranged to be opened by engagement of the lower end of the second stage **1-*b* of the mast with an upwardly projecting stem 67 on the safety valve when the work platform is in a fully lowered position. Depression of this valve stem 67 permits the large piston area side of the cylinder unit 20 to dump to the sump 52 via lines 68, 69 in response to operation of the foot pump 42 to retract the piston rod 20*b* and lower the carriage 13 into ground engagement. Otherwise, the piston rod 20*b* cannot be retracted because the safety valve 67 will not permit discharge of hydraulic fluid from the large piston area end of the carriage lowering cylinder unit 20**.

Figure 12:
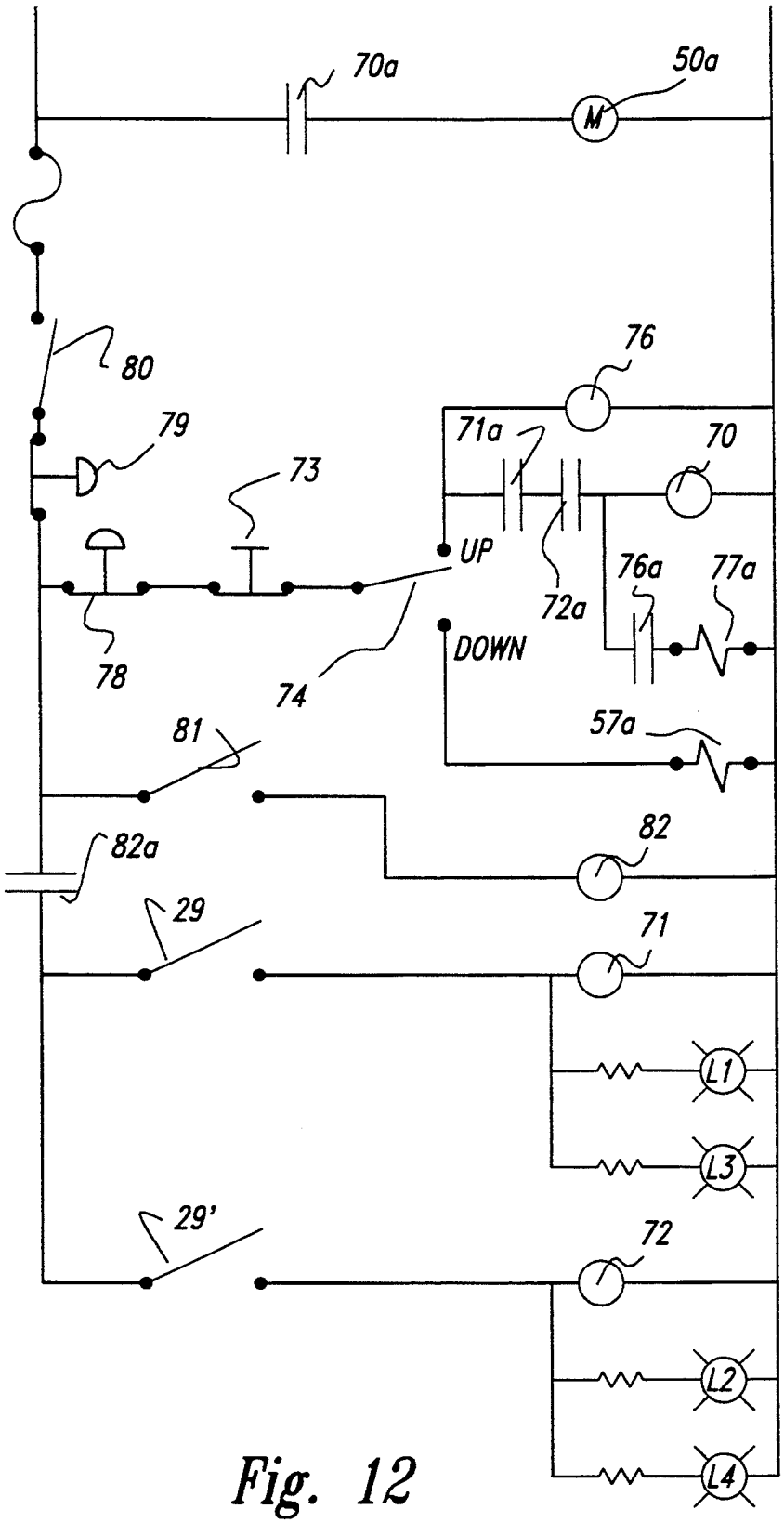
FIG. 12 is a schematic of the electrical system.

Referring to the electrical schematic (FIG. 12), it is seen that the motor **50*a* for the lift pump 50 is started to raise the lift responsive to the closing of a switch 70*a* operated by a relay 70. This relay is energized when normally closed switches 71*a*, 72*a*, of relays 71, 72 are closed, control active switch 73 is manually closed, and up/down switch 74 is closed in the UP position by the person on the working platform. Relay switches 71*a*, 72*a* will be closed unless one of the magnetic switches 29, 29' is open indicating that the respective support leg 23 or 23' is not properly in ground engagement. In that case a normally lighted pair of indicator lights L1–L3 or L2–L4 on a control panel at the front of the control box 38 will not be lighted, thereby indicating to the operator which support leg is not taking its share of the weight of the lift. Assuming switches 71*a*, 72*a* are closed and switch 74 is in the UP position, a time delay relay 76 is actuated to close a solenoid energizing switch 76*a* for the solenoid 77*a* of a normally open solenoid valve 77 which, while remaining open, dumps the output of the lift pump 50 to the sump 52. After a short time delay giving the motor 50 time to build up speed, the relay 76 closes switch 76*a* so that valve 77 is closed by its solenoid and delivery of pressurized fluid to the lift cylinder 33 commences. Emergency push button switches 78, 79 are provided at the work platform panel 39 and on the control box 38, respectively. It is preferred to also provided a key operated switch 80** so that an unauthorized person can not start the lift.

When the up/down switch 74 is moved to the DOWN position the solenoid **57*a* for valve 57 is energized, thereby opening normally closed solenoid valve 57 so that the lift cylinder 33 can empty via flow compensator 60, lines 55, 54, and valve 57 to the sump 52. A vent line 81** can be provided from the upper end of the lift cylinder to drain any leakage past the piston in the lift cylinder unit.

If the lift were supported, by the screw jacks 24, 24' on a sloped planar surface it would be possible for each of the screw jacks and support legs 23, 23' to be loaded by the weight of the lift, thereby closing the magnetic switches 29 for both support legs, so that the previously described safety features would not be effective. For this reason the lift is also provided with a level indicator mounted on the bottom stage **1-*a* of the mast. This level indicator may be a pendulum type unit in which swinging of the pendulum periodically closes a level sensor switch 81. If this switch is closed longer than a predetermined pendulum swing period of three seconds, for example, indicating that the base frame 2 is too far out of level, a time delay relay 82 opens a normally closed switch 82*a*. It will be noted that this results in deactivation of the solenoids 71, 72, and hence results in opening of relay switches 71*a*, 72*a* and deactivation of the motor control solenoid 70 if the switch 74 is placed in the UP position. Thus the pump 50 will not operate for raising the mast while the base frame 2** is out of level a predetermined extent.

From the foregoing description it is seen that the safety system of the present invention prevents operation of the mast whenever the base frame 2 is tilted or is in danger of being tilted a predetermined amount, and/or when the lift is supported by the wheels 14, 14' and casters 15, 15' on the carriage frame 13 instead of being supported by the support legs 23, 23' and screw jacks 24, 24' on the base frame 10. It is also seen that the safety system prevents transfer of the weight of the lift to the carriage while the mast is in an elevated condition.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A lift comprising;

a base frame assembly having support elements for ground engagement;

a lifting device mast mounted on said base frame;

a carriage assembly including a rigid carriage frame on which transport wheels are mounted, said carriage assembly being mounted on said base frame assembly for movement from an inactive position in which said support elements are in ground engagement supporting the weight of said base frame assembly and lifting device, to an active position in which said weight is entirely supported on said transport wheels;

and carriage assembly operating means for selectively moving said carriage assembly from inactive position to active position.

2. A lift according to claim 1 in which hydraulic means is provided for extending said mast, and control means is provided for disabling said hydraulic means to prevent said mast from extending from its said retracted position whenever said carriage is in said active position.

3. A lift according to claim 1 in which control means is provided for disabling said operating means from moving said carriage assembly from inactive position to active position when said mast is not in its said retracted position.

4. A lift comprising;

a base frame assembly having support elements for ground engagement;

a lifting device mast mounted on said base frame;

a carriage assembly including a rigid carriage frame on which transport wheels are mounted, said carriage assembly being mounted on said base frame assembly for movement from an inactive position in which said support elements are in ground engagement supporting the weight of said base frame assembly and lifting device to an active position in which said weight is entirely supported on said transport wheels;

said carriage assembly being supported by rollers mounted on opposite sides thereof which are arranged to roll along parallel sloped tracks mounted on said base frame assembly;

and power means for selectively moving said carriage assembly downwardly along said tracks from said inactive position to said active position.

5. A lift according to claim 4 in which said power means comprises a hydraulic cylinder unit having a cylinder pivotally mounted on one of said assemblies and having a piston rod extending from a piston in said cylinder and pivotally mounted on the other one of said assemblies.

6. A lift assembly according to claim 5 in which the slope of said tracks is such that said carriage assembly moves from said inactive position to said active position responsive to retraction of said piston rod into said cylinder.

7. A lift according to claim 2 in which said support elements include a pair of jacks and a pair of support legs, each of said support legs being diagonally opposite one of said jacks.

8. A lift according to claim 7 in which said carriage assembly has a pair of wheels and a pair of casters for ground support when said carriage assembly is in said active position.

9. A lift comprising;

a base frame having depending support elements for ground engagement;

a multi-stage lift device mounted on said frame, said device being vertically extendible from a retracted position;

a hydraulic means for extending said device including a hydraulic circuit with a pump;

a carriage assembly mounted on said base frame assembly for movement from an inactive position in which said support elements are in ground engagement supporting the weight of said base frame and lift device to an active position in which said carriage is in ground engagement and said weight is supported on said carriage;

and carriage operating means for selectively moving said carriage from inactive position to active position only when said lift device is in its retracted position, and for preventing said pump from operating to vertically extend said lift device from its said retracted position whenever said carriage is in active position.

10. A lift according to claim 9 in which a pair of said support elements each comprises a depending guide, a leg slidably mounted in said guide, a spring biasing said leg downwardly relative to said base frame assembly from a retracted position, a switch arranged to be closed when said leg is in said retracted position;

said pump being powered by an electric motor in a control circuit including said switches which is active only when said switches are closed.

11. A lift according to claim 10 in which a second pair of said support elements each comprises a jack.

12. A lift comprising;

a base frame having support elements for ground engagement;

a lift device mounted on said base frame;

a carriage including a rigid carriage frame on which transport wheels are mounted, said carriage being mounted on said frame for movement from an inactive position in which said support elements are in ground engagement supporting said base frame, to an active position in which said support elements are raised and said base frame is entirely supported on said transport wheels, carriage operating means for selectively moving said carriage from inactive position to active position;

said carriage operating means comprising a hydraulic cylinder unit mounted between said base frame and carriage and having a pressurized condition when said carriage is in its active position; and a supply pump for selectively supplying pressurized hydraulic fluid to said cylinder unit.

13. A lift according to claim 12 in which said supply pump is operated by a foot pedal mounted on said base frame for up and down swinging movement.

14. A lift according to claim 12 in which said base frame has a pair of parallel, downwardly sloped tracks on opposite sides thereof, and said carriage has respective rollers riding in said tracks, said hydraulic cylinder unit urging said carriage downwardly along said tracks when in said pressurized condition.

15. A lift according to claim 14 in which said lift device comprises a multi-stage mast, and means for preventing extension of said mast when said base frame is supported by said carriage.

16. A lift according to claim 15 in which means are provided for preventing movement of said carriage from its inactive position when said mast is extended.

17. A lift comprising;

a base frame having support elements for ground engagement;

a lift device mounted on said base frame;

a carriage including a rigid carriage frame on which transport wheels are mounted, said carriage being mounted on said frame for movement from an inactive position in which said support elements are in ground engagement supporting said base frame, to an active position in which said support elements are raised and said base frame is entirely supported on said transport wheels;

carriage operating means for selectively moving said carriage from inactive position to active position;

said carriage operating means comprising a hydraulic cylinder unit mounted between said base frame and carriage and having a pressurized condition when said carriage is in its active position;

a supply pump for selectively supplying pressurized hydraulic fluid to said cylinder unit;

said lift device comprising a multi-stage mast, a hydraulic lift cylinder for raising the mast from a retracted position and a motor-driven pump connected to said lift cylinder by a hydraulic circuit means which also includes said supply pump;

and means in said hydraulic circuit means for subjecting said hydraulic cylinder unit with pressurized hydraulic fluid being supplied to said lift cylinder unit by said motor-driven pump to oppose in said hydraulic cylinder unit pressurized hydraulic fluid being supplied thereto by said supply pump, said hydraulic cylinder unit including a piston having one of its sides subjected to pressurized fluid from said motor-driven pump and having its other side of smaller area and subjected to pressurized fluid from said supply pump.

18. A lift according to claim 17 in which said supply pump is operated manually.

19. A lift according to claim 17 in which said hydraulic circuit means includes a normally open valve arranged to be closed by said mast when the mast is in said retracted position, said valve being arranged in said hydraulic circuit means such as to prevent dumping of hydraulic fluid from the side of said piston which is subjected to pressure from said motor-driven pump.

20. A load supporting assembly comprising:

a base frame assembly having support elements for ground engagement;

a load on said base frame assembly;

a carriage having front and rear wheels mounted on said base frame for movement on a sloped path from an inactive position in which said support elements are in ground engagement supporting the weight of said base frame and load, to an active position in which said entire weight is supported on said carriage wheels with the wheels in ground engagement;

and carriage operating means for selectively moving said carriage on said sloped path from inactive position to active position.

* * * * *

UNITED STATES PATENT AND TRADEMARK OFFICE

CERTIFICATE OF CORRECTION

PATENT NO. : 5,337,858

DATED : August 16, 1994

INVENTOR(S) : Willibald Neubauer et al.

It is certified that error appears in the above-indentified patent and that said Letters Patent is hereby corrected as shown below:

On the title page item [75], delete "Willi B. Neubauer" and substitute therefor --Willibald Neubauer--.

Signed and Sealed this

Fourth Day of April, 1995

*Attest:*

*Attesting Officer*

BRUCE LEHMAN

*Commissioner of Patents and Trademarks*